United States Patent [19]

Ferleger

[11] Patent Number: 4,784,571

[45] Date of Patent: Nov. 15, 1988

[54] APPARATUS AND METHOD FOR REDUCING BLADE FLOP IN STEAM TURBINE

[75] Inventor: Jurek Ferleger, Longwood, Fla.

[73] Assignee: Westinghouse Electric Corp., Pittsburgh, Pa.

[21] Appl. No.: 12,778

[22] Filed: Feb. 9, 1987

[51] Int. Cl.[4] ..... F01D 5/22

[52] U.S. Cl. ..... 416/191; 416/196 R

[58] Field of Search ..... 416/190, 191, 192, 193 R, 416/195, 196 R, 193 A, 219 R, 220 R, 221

[56] References Cited

U.S. PATENT DOCUMENTS

| | | | |
|---|---|---|---|
| 1,423,466 | 7/1922 | Snyder | 416/191 |
| 2,430,140 | 11/1947 | Phelan et al. | 416/191 X |
| 2,942,843 | 6/1960 | Sampson | 416/190 |
| 2,999,631 | 9/1961 | Wollmershauser | 416/193 X |
| 3,209,838 | 10/1965 | Frankel | 416/191 |
| 3,295,825 | 1/1967 | Hall | 416/221 |
| 3,326,523 | 6/1967 | Bobo | 416/221 X |
| 3,752,598 | 8/1973 | Bowers et al. | 416/191 X |
| 3,752,599 | 8/1973 | Pace | 416/190 |
| 3,981,615 | 9/1976 | Krol | 416/190 |
| 4,533,298 | 8/1985 | Partington et al. | 416/191 |
| 4,602,412 | 7/1986 | Partington et al. | 29/156.8 B |

FOREIGN PATENT DOCUMENTS

| | | | |
|---|---|---|---|
| 1374917 | 8/1964 | France | 416/195 |
| 92006 | 8/1978 | Japan | 416/190 |
| 14803 | 2/1981 | Japan | 416/190 |
| 92303 | 7/1981 | Japan | 416/191 |
| 38602 | 3/1982 | Japan | 416/190 |
| 168007 | 10/1982 | Japan | 416/190 |
| 4808 | 1/1986 | Japan | 416/220 R |
| 174305 | 2/1961 | Sweden | 416/220 |
| 1503453 | 3/1978 | United Kingdom | 416/190 |

*Primary Examiner*—Everette A. Powell, Jr.

[57] ABSTRACT

A steam turbine of the type employing a plurality of axial entry, integral shroud blades comprises spring means resident in a slot machined in at least one face of each shroud. The spring means urge against the adjacent shroud and reduce relative motion between adjacent blades.

20 Claims, 3 Drawing Sheets

APPARATUS AND METHOD FOR REDUCING BLADE FLOP IN STEAM TURBINE

BACKGROUND OF THE INVENTION

1. Field of the Invention

The present invention relates generally to steam turbines, and more specifically to an apparatus and method for reducing blade "flop" that may occur during turning gear operation. The present invention has particular application to steam turbines of the type employing "axial entry, integral shroud" blades, but is not limited thereto.

2. Description of the Prior Art

Steam turbines of the type employing "axial entry, integral shroud" blades comprise a rotor with a disc (i.e., the portion of the rotor that holds the blades) having a plurality of generally fir tree-shaped, generally axially extending grooves, with the blades circularly disposed therearound. Each blade has a generally fir tree-shaped root at a proximal end thereof in registration with one of the grooves and a shroud integral with the blade at a distal end thereof. As is known, blade "flop" may occur during turning gear operation of the turbine, i.e., the blade root may rock circumferentially, and even axially, in the groove with which it is registers when the centrifugal force is insufficient to urge the root radially outward, thereby causing root/groove fretting and undesired noise. Additionally, gaps between adjacent shrouds may open under hot disc conditions and contribute to blade flop. Moreover, the mating faces of adjacent shrouds may wear from snubbing therebetween. Obviously, these are undesirable conditions.

SUMMARY OF THE INVENTION

An apparatus for reducing blade flop comprises spring means resident in a generally axially extending slot disposed in at least one face of each shroud. The spring means urges against the shroud adjacent the slot whereby the force exerted by the spring means reduces relative motion between adjacent blades. According to one embodiment of the invention, there is only a single slot disposed in each shroud. According to another embodiment of the invention, there is a generally axially extending slot disposed in both faces of each shroud, and the slots in opposing faces of adjacent shrouds are substantially aligned so that each spring means resides in the aligned slots. An access slot disposed in the top of each shroud that communicates with the slot in the face of the shroud may be provided to aid in the insertion and removal of the spring means. According to the preferred embodiment of the invention, each spring means comprises a leaf spring. According to another embodiment of the invention, each spring means comprises a washer such as a Belleville washer.

A method of assembling the turbine to reduce blade flop comprises the steps of machining a generally axially extending slot in at least one face of each shroud and inserting a spring means in each slot so that each spring means urges against the adjacent shroud.

Reference is made to commonly assigned copending application Ser. No. 18,322, filed Feb. 24, 1987, now U.S. Pat. No. 4,767,273 for a related but alternate solution to the problem addressed by this invention.

DESCRIPTION OF THE PREFERRED EMBODIMENT

Figure 1:
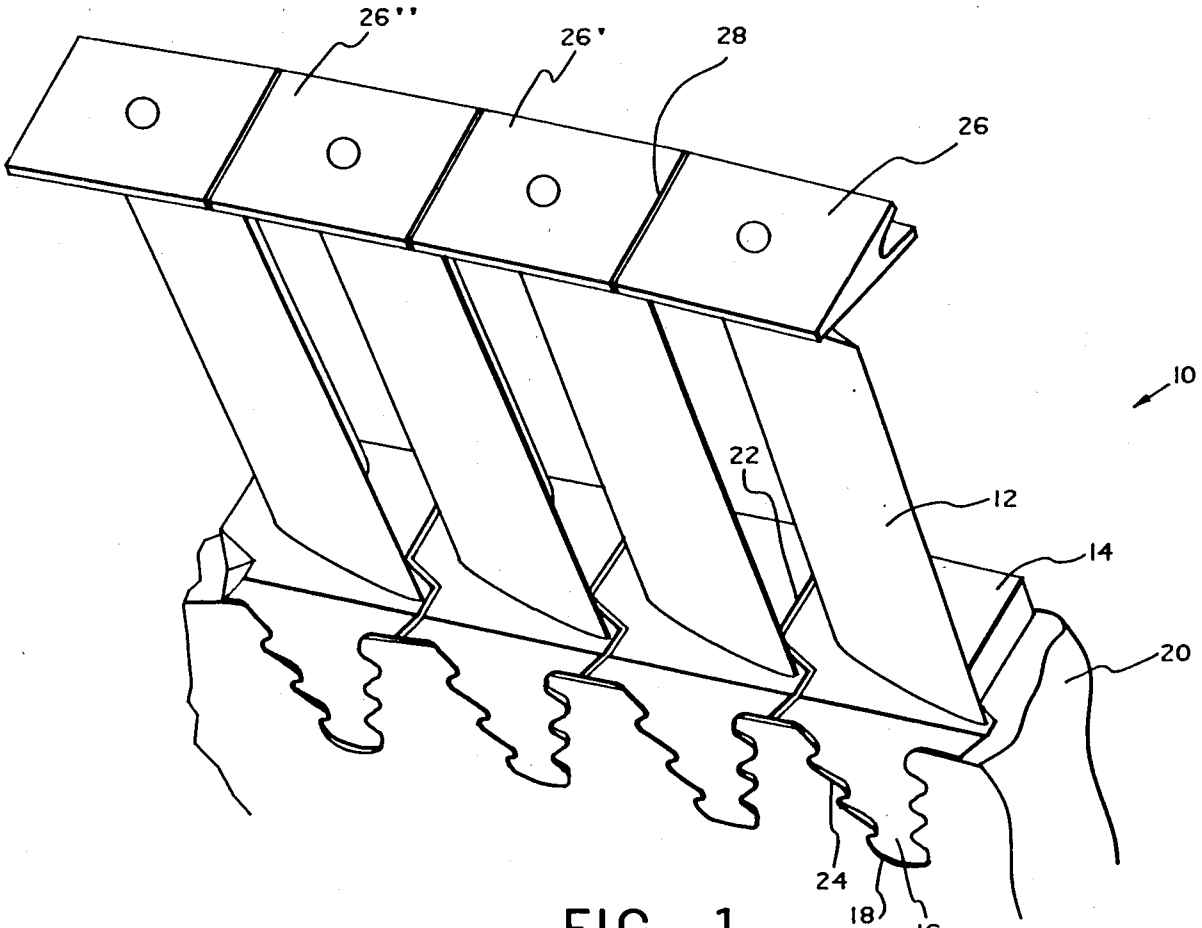
FIG. 1 is a perspective view of a section of a steam turbine of the type employing "axial entry, integral shroud" blades.

Referring now to the drawings, wherein like numerals represent like elements, there is illustrated in FIG. 1 a portion of a turbine labelled generally 10 comprising a disc 20 and a plurality of blades 12. Each blade 12 comprises a platform 14, a root 16 disposed at the proximal end thereof and an integral shroud 26 disposed at the distal end thereof. The disc 20 comprises a plurality of generally axially extending grooves 18 disposed therearound. As illustrated, each root 16 and each groove 18 have a generally fir tree shape and each root 16 is in registration with one of the grooves 18.

Although it is often desirable to minimize the gap between adjacent platforms 14, there may be a small clearance 22 between adjacent platforms 14 which may open further under hot disc conditions. Additionally there may be a small clearance 24 between each blade root 16 and the edges of the groove 18 with which the root 16 registers. Still further, there may be a small clearance 28 between adjacent shrouds 26, 26' which may also open further under hot disc conditions. The existence of the gaps 22, 24, and 28 may result in blade "flop" during turning gear operation. Still further, the mating faces, e.g., 40, 46 (FIG. 2) of adjacent shrouds may wear from snubbing.

Figure 2:
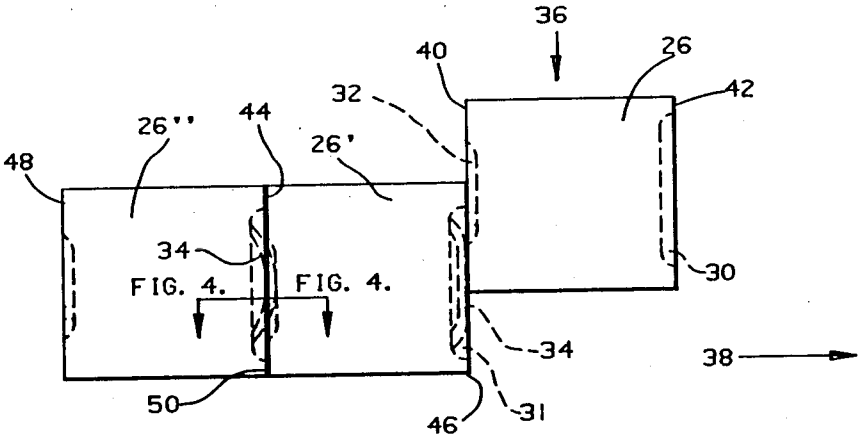
FIG. 2 is a top plan view of a plurality of adjacent integral shrouds employing the spring means of the present invention.

As illustrated in FIG. 2, shroud 26 has a pair of faces 40, 42. Shroud 26' has a pair faces 44, 46 and shroud 26'' has a pair of faces 48, 50. Face 40 of shroud 26 opposes face 46 of shroud 26'. (Shroud 26 is shown as being only partially inserted, but it should be understood that when the shroud 26 is fully inserted by sliding in the direction of arrow 36, the faces 40 and 46 will fully oppose each other). Similarly, face 44 of shroud 26' opposes face 50 of shroud 26'. Thus, the shroud of each blade has a pair of faces that oppose faces of adjacent shrouds.

As also shown in FIG. 2, there is at least one generally axially extending slot disposed in at least one of the faces of each shroud. Thus, there is a generally axially extending slot 30 disposed in the face 42 of shroud 26, a generally axially extending slot 31 disposed in the face 46 of slot 26', and so on. See FIGS. 2 and 3. If desired, a generally axially extending slot may be disposed in both faces of each shroud. Thus, shroud 26 may be provided with a second generally axially extending slot 32 in the face 40 thereof. Shrouds 26', 26'', etc. may also be provided with similar second slots as shown. Preferably, the slots in opposing faces of adjacent shrouds are substantially aligned in the axial direction, as shown in FIG. 2. Thus, when shroud 26 is fully inserted, the slot 32 will be aligned with the slot 31, and so on.

Figure 3:
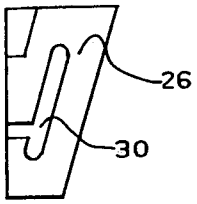
FIG. 3 is a side plan view of a shroud machined with a slot according to the present invention.

As shown in FIG. 3, there may be an access slot disposed in the top of each shroud that communicates with the slot in the face of each shroud for reasons described below.

Resident in each of the generally axially extending slots is a spring means 34. As will be appreciated, when installed, each spring means 34 will urge against the adjacent shroud. It will also be appreciated that the force exerted by the spring means 34 will reduce relative motion between adjacent blades.

Figure 5:
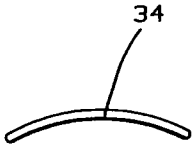
FIG. 5 is a side view of one embodiment of a spring means according to the present invention.

The spring means 34 may be a leaf spring, such as illustrated in FIG. 5. Alternatively, the spring means 34 may be a washer spring, such as a Belleville washer. If a Belleville washer is used, the shape of the slot should be modified accordingly.

Figure 4:
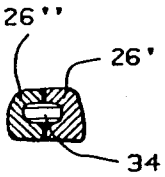
FIG. 4 is a cross-section taken along line 4—4 of FIG. 2.

FIG. 4 illustrates in further detail the cooperation between the spring means 34 and adjacent shrouds, 26', 26'' and the substantial radial alignment of slots 31, 32.

According to the present invention, a method of assembling a turbine of the type hereinbefore described comprises the following steps. First, a generally axially extending slot is machined in at least one face of each shroud. A first blade 12 is inserted in the disc 20 by registering its root 16 with a groove 18. A spring means 34 is placed in the slot and held therein while the root 16 of another blade 12 is inserted, as shown by arrow 38, into the next groove 18 (see FIG. 2). As will be appreciated, the spring means 34 compresses against the faces of adjacent shrouds to prevent movement therebetween. Assembly in this manner is continued in the direction of the arrow 38, around the disc, until all blades have been installed.

The access slots provided in the top of the shrouds permit easy insertion and removal of the spring means, e.g., by the use of a screwdriver.

The present invention provides the following advantages:

(1) Blade flop during turning gear operation is minimized. This is particularly true in designs where a nominal gap is intentionally provided between adjacent shrouds to avoid shroud compression and/or buckling.

(2) Assembly of the turbine is simplified since the assembler no longer need be concerned if there are gaps between adjacent shrouds.

(3) Wear between opposing faces of adjacent shrouds will be reduced.

(4) Blades whose shroud faces are already excessively worn can be saved by machining the slot and providing the spring means of the present invention.

(5) The spring means may serve as an additional means of locking the "closing blade", i.e., the last blade inserted in a row. As is known, a special locking device is currently required to lock the "closing blade". See, e.g., commonly assigned copending patent application Ser. No. 844,496 filed Mar. 26, 1986.

(6) The spring means may help to increase shroud interference (snubbing) in the second mode of vibration, which is predominantly in the axial direction.

Figure 6:
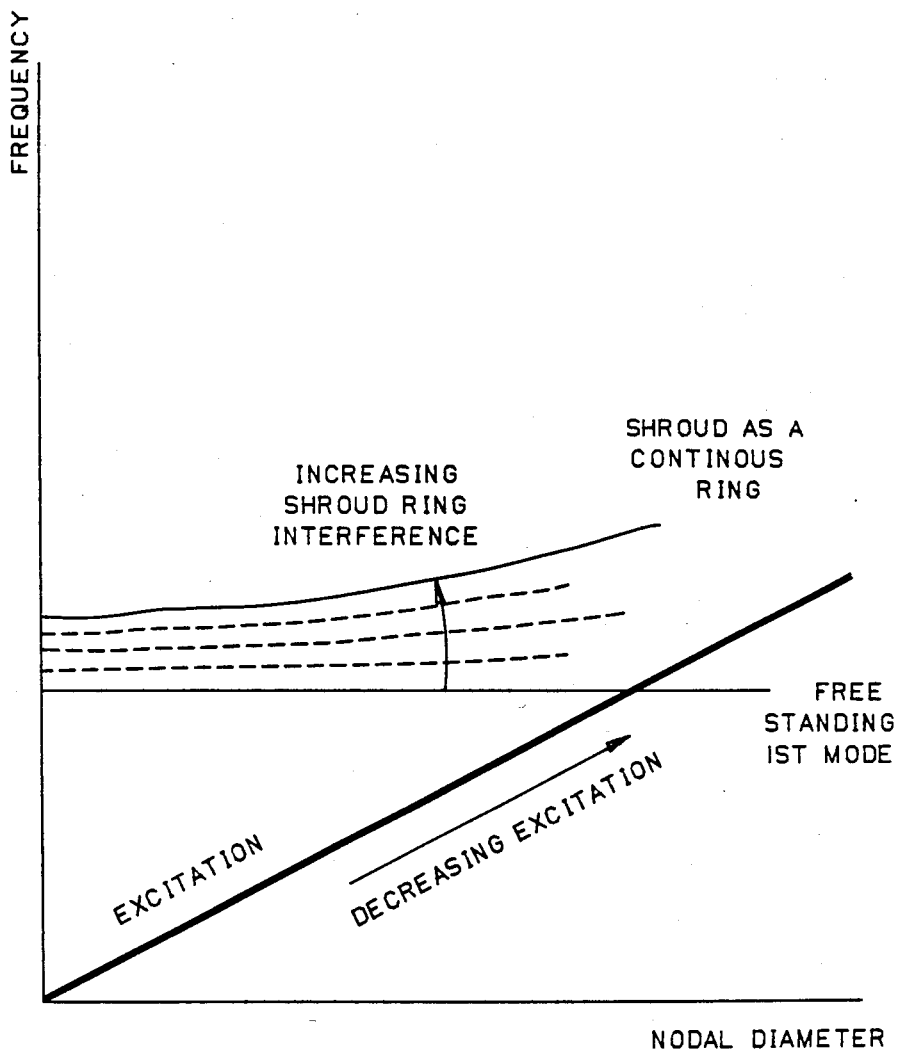
FIG. 6 is a graph of fundamental frequencies of continuous rows of integral shroud blades versus nodal diameter and demonstrates an improved blade vibratory characteristic of a turbine employing the present invention.

(7) As illustrated in FIG. 6, implementation of the present invention improves the blades' vibratory characteristics. Increasing shroud interference may help to raise system frequency which, in turn, results in lower blade stresses.

The present invention may be embodied in other specific forms without departing from the spirit or essential attributes thereof and, accordingly, reference should be made to the appended claims, rather than to the foregoing specification, as indicating the scope of the invention.

I claim as my invention:

1. In a steam turbine having a disk with at least one groove disposed therearound and a plurality of blades, each blade having a root disposed at a proximal end thereof in registration with a groove and a shroud integral with the blade at a distal end thereof, the shroud of each blade having a pair of faces that oppose faces of the shrouds of adjacent blades, an apparatus for reducing relative motion between adjacent blades comprising resilient means disposed in each one of a slot machined in at least one face of each shroud for urging against the shroud adjacent each slot, the slot having a length less than the width of the shroud face, the slot encapsulating the resilient means disposed therein, and an access slot for receiving a tool to manipulate the resilient means during and after assembly.

2. Apparatus according to claim 1 wherein the slots extend in generally the axial direction of the disc.

3. Apparatus according to claim 1 wherein a plurality of disc grooves extend in generally the axial direction of the disc.

4. Apparatus according to claim 1 wherein the resilient means comprise leaf springs each having two ends and both ends of each spring contact one shroud face.

5. Apparatus according to claim 1 wherein the resilient means comprise washer springs.

6. Apparatus according to claim 1 wherein there is a generally axially extending slot disposed in both faces of each shroud, the slots in opposing faces of adjacent shrouds being substantially aligned, the resilient means being disposed in the aligned slots.

7. Turbine according to claim 1 wherein each shroud has a top and wherein the access slot is disposed in the top of each shroud, the access slot communicating with the slot in the face of the shroud.

8. Turbine according to claim 1 wherein the resilient means is shaped to exert a force sufficient to reduce relative motion between each root and the groove with which it registers.

9. Steam turbine comprising:

(a) a disc having a plurality of generally fir tree shaped, generally axially extending grooves exposed therearound;

(b) a plurality of blades circularly disposed around the disc, each blade having a fir tree shaped root at a proximal end thereof in registration with one of the grooves and a shroud integral with the blade at a distal end thereof; the shroud of each blade having a pair of faces that oppose faces of the shrouds of adjacent blades, there being a generally axially extending slot disposed in at least one face of each shroud, the slot having a length less than the width of the face of each shroud, there also being an access slot; and (c) spring means disposed in each axially extending slot, spring means urging against the shroud adjacent each axially extending slot, whereby the force exerted by the spring means is sufficient to reduce relative motion between adjacent plates, the access slot being for receiving a tool to manipulate the spring means during and after assembly.

10. Turbine according to claim 9 wherein there is a generally axially extending slot disposed in both faces of each shroud, the slots in opposing faces of adjacent shrouds being substantially aligned, the spring means being disposed in the aligned slots.

11. Turbine according to claim 9 wherein each shroud has a top and wherein the access slot is disposed in the top of each shroud, the access slot communicating with the slot in the face of the shroud.

12. Turbine according to claim 9 wherein the spring means is shaped to exert a force sufficient to reduce relative motion between each root and the groove with which it registers.

13. Turbine according to claim 9 wherein the spring means comprise leaf springs, each having two ends, and both ends of each spring contact one shroud face.

14. Turbine according to claim 9 wherein the spring means comprise washer springs.

15. In a steam turbine of the type having a disk with a plurality of generally fir tree shaped, generally axially extending grooves and a plurality of blades, each blade having a fir tree shaped root at a proximal end thereof in registration with one of the grooves of a shroud integral with the blade at a distal end thereof, the shroud of each blade having a pair of adjacent faces that oppose faces of the shrouds of adjacent blades, a method of assembling the turbine to reduce relative motion between adjacent blades comprising the steps of:

(a) machining a generally axially extending slot and an access slot in at least one face of each shroud; and (b) inserting a spring means in each axially extending slot so that each spring means urges against the shroud adjacent each axially extending slot.

16. Method according to claim 15 wherein the step of machining an access slot in the top each shroud comprises machining a slot that communicates with the axially extending slot in the face of the shroud, and inserting a tool into the access slot to insert and remove the spring means via the access slot.

17. Method according to claim 15 wherein the first-mentioned step comprises machining a generally axially extending slot in both faces of each shroud, the slots in opposing faces of adjacent shrouds being substantially aligned.

18. Method according to claim 15 wherein the spring means is shaped to exert a force sufficient to reduce relative motion between each root and the grove with which it registers.

19. Method according to claim 15 wherein the spring means comprise leaf springs each having two ends, and both ends of each spring contact one shroud face.

20. Method according to claim 15 wherein the spring means comprise washer springs.

* * * * *